US007121243B2

(12) United States Patent
Yoshijima et al.

(10) Patent No.: US 7,121,243 B2
(45) Date of Patent: Oct. 17, 2006

(54) VALVE CASE AND RESIN CYLINDER HEAD COVER

(75) Inventors: Kazuya Yoshijima, Okazaki (JP); Hidemi Kato, Aichi (JP); Akihiro Osaki, Okazaki (JP); Naohiro Hasegawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/171,460

(22) Filed: Jul. 1, 2005

(65) Prior Publication Data

US 2006/0011158 A1 Jan. 19, 2006

(30) Foreign Application Priority Data

Jul. 14, 2004 (JP) ..... 2004-207444

(51) Int. Cl.
*F01M 9/10* (2006.01)

(52) U.S. Cl. ..... 123/90.38; 123/90.34; 123/90.12; 123/90.17; 123/193.5; 29/888.061

(58) Field of Classification Search ..... 123/90.38
See application file for complete search history.

(56) References Cited

U.S. PATENT DOCUMENTS 6,076,492 A * 6/2000 Takahashi ..... 123/90.17
6,289,861 B1 * 9/2001 Suzuki ..... 123/90.17
6,684,836 B1 * 2/2004 Inoue ..... 123/90.17
6,832,587 B1 * 12/2004 Wampula et al. ..... 123/90.38
6,912,982 B1 * 7/2005 Lehmann et al. ..... 123/90.15

FOREIGN PATENT DOCUMENTS

| | | |
|---|---|---|
| JP | A-11-210425 | 8/1999 |
| JP | A-2003-227321 | 8/2003 |
| JP | B2-3525709 | 2/2004 |
| JP | A-2004-232615 | 8/2004 |

* cited by examiner

*Primary Examiner*—Thomas Denion
*Assistant Examiner*—Kyle M. Riddle
(74) *Attorney, Agent, or Firm*—Oliff & Berridge, PLC

(57) ABSTRACT

A valve case includes an attaching portion and a sleeve. The valve case is attached to a cylinder head cover main body formed of resin. The attaching portion is formed of resin and is a portion of the valve case to which an oil control valve is to be attached. The sleeve is embedded in the attaching portion, and has an interior space that permits the oil control valve to be accommodated therein and oil holes. Each oil hole is selectively connected to one of ports of the oil control valve accommodated in the interior space of the sleeve. The sleeve is formed of material having higher rigidity than the resin forming the attaching portion. Therefore, the valve case prevents deformation of the attaching portion.

11 Claims, 5 Drawing Sheets

VALVE CASE AND RESIN CYLINDER HEAD COVER

BACKGROUND OF THE INVENTION

The present invention relates to a valve case to which an oil control valve (OCV) is attached that controls supply and drainage of hydraulic pressure to and from a variable valve actuation mechanism of an internal combustion engine, and to a resin cylinder head cover having such a valve case.

In a case where a hydraulically operated variable valve actuation mechanism is provided for a timing sprocket or a timing pulley of an internal combustion engine, hydraulic pressure supplying/draining oil passages from the oil control valve to the variable valve actuation mechanism are normally formed through a camshaft.

For such a case, for example, a configuration has been proposed in which an oil control valve is attached to the inner surface of the cylinder head cover, and the oil control valve controls supply and drainage of the hydraulic pressure through oil passages in a cam cap and the oil passages in the camshaft.

However, according to the configuration in which the oil control valve is accommodated inside the cylinder head cover as described above, the height of the cylinder head cover is increased by a space necessary for accommodating the oil control valve. This undesirably increases the size of the internal combustion engine. Therefore, a technique has been proposed in which an oil control valve is accommodated in a valve case attached to the cylinder head cover to cover an opening formed in the upper wall of the cylinder head cover (for example, see Japanese Patent No. 3525709).

If the cylinder head cover and the valve case configured as described above are formed with resin to achieve the weight reduction, since the rigidity of resin is generally lower than that of metal, the cylinder head cover may be distorted or deformed when attaching the cylinder head cover to a cylinder head. This may, in turn, affect the valve case.

The dimensional accuracy of the attaching portion to which the oil control valve is attached may be decreased due to such distortion or deformation. Thus, the oil control valve may not be properly attached to the attaching portion or the oil control valve may malfunction.

SUMMARY OF THE INVENTION

Accordingly, it is an objective of the present invention to provide a resin cylinder head cover and a valve case that prevent deformation of an attaching portion to which an oil control valve is attached.

To achieve the foregoing and other objectives and in accordance with the purpose of the present invention, a valve case that permits an oil control valve to be attached is provided. The oil control valve has ports and controls supply and drainage of hydraulic pressure to and from a variable valve actuation mechanism of an internal combustion engine. The valve case is attached to a cylinder head cover main body formed of resin. The valve case includes an attaching portion, a sleeve, an oil passage coupling portion, and a joint portion. The attaching portion is formed of resin and is a portion of the valve case to which the oil control valve is to be attached. The sleeve is embedded in the attaching portion, and has an interior space that permits the oil control valve to be accommodated therein and oil holes. Each oil hole is selectively connected to one of the ports of the oil control valve accommodated in the interior space of the sleeve. The sleeve is formed of material having higher rigidity than the resin forming the attaching portion. The oil passage coupling portion is formed of resin. The oil passage coupling portion has intermediate oil passages. The intermediate oil passages each connect one of the oil holes of the sleeve to a corresponding one of cam cap oil passages formed in a cam cap of the internal combustion engine to selectively supply and drain hydraulic pressure to and from the variable valve actuation mechanism. The joint portion is formed of resin and is located at the outer circumference of a portion of the valve case between the attaching portion and the oil passage coupling portion or at the outer circumference of the oil passage coupling portion. The joint portion is joined to the cover main body so that the valve case is attached to the cover main body.

The present invention also provides a resin cylinder head cover having a cylinder head cover main body and the aforementioned valve case. The cylinder head cover main body is formed of resin and has an opening portion. The valve case is attached to the cover main body to close the opening portion of the cover main body by inserting the oil passage coupling portion into the opening portion and joining the joint portion to the cover main body around the opening portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
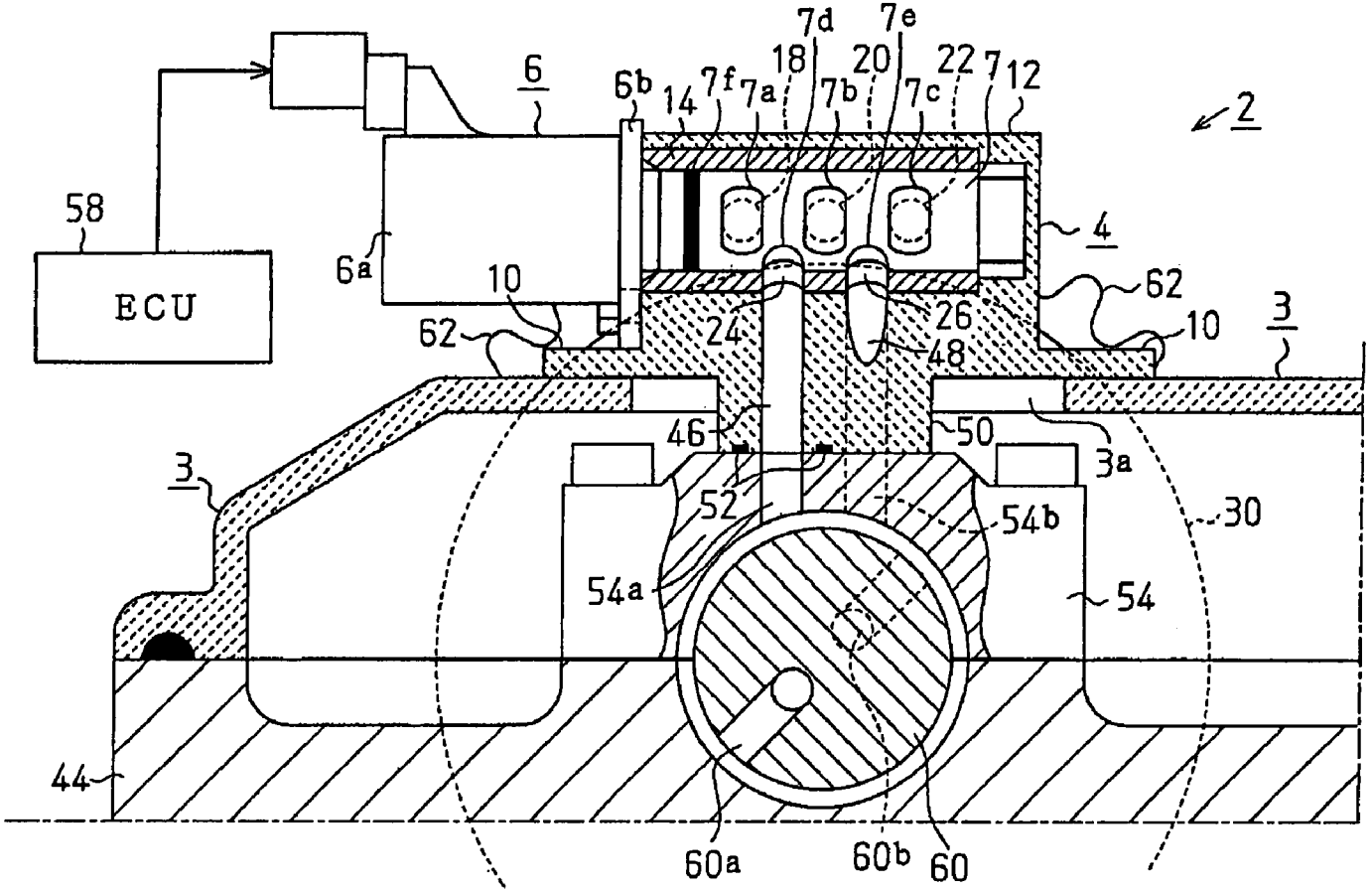
FIG. 1 is a longitudinal cross-sectional view illustrating part of a resin cylinder head cover according to a first embodiment of the present invention to which an OCV is attached and the vicinity thereof.
Figure 2:
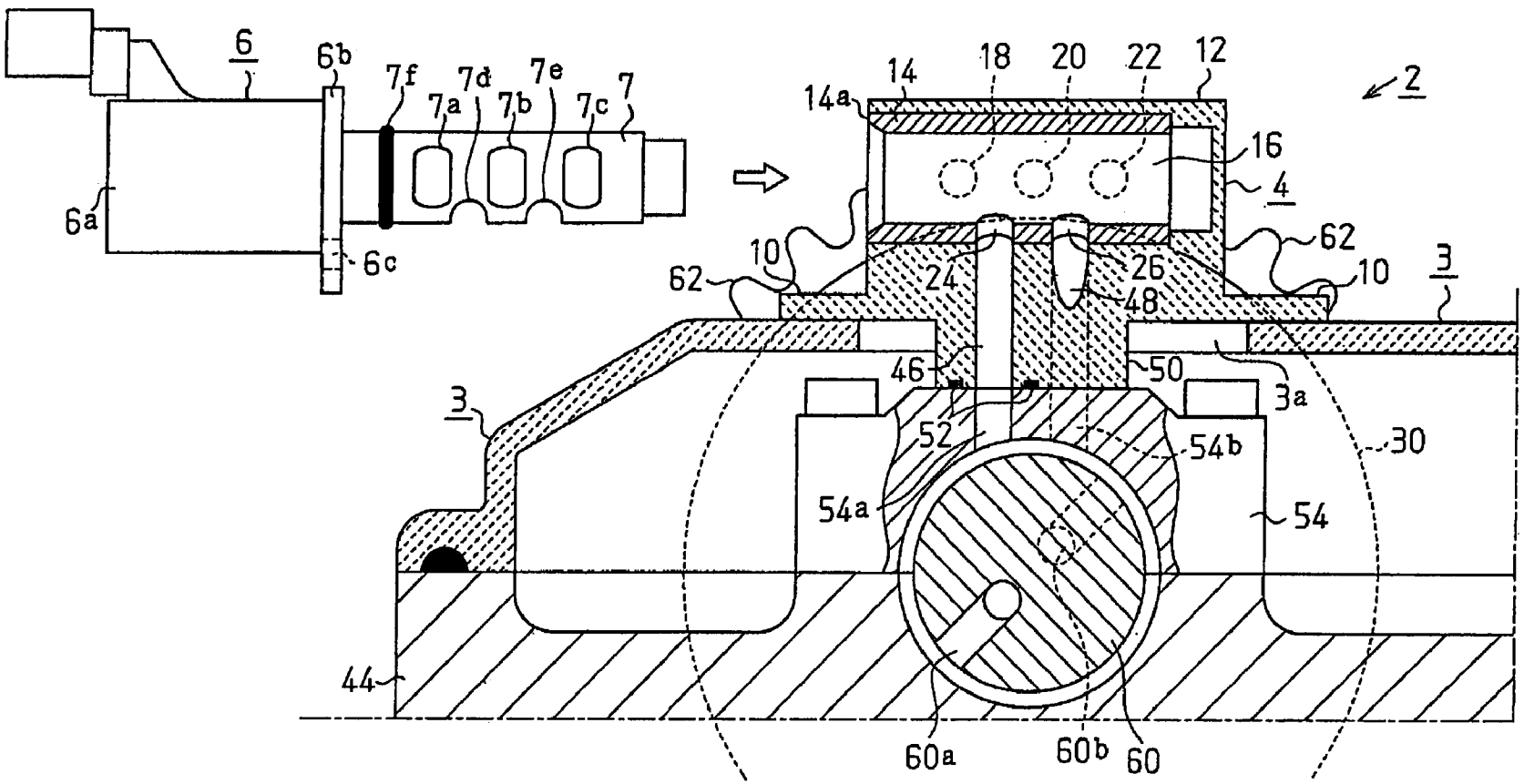
FIG. 2 is a longitudinal cross-sectional view illustrating, together with the OCV, the part of the resin cylinder head cover of FIG. 1 before the OCV is attached and the vicinity thereof.

A first embodiment of the present invention will now be described with reference to FIGS. 1 to 4(E). FIG. 1 shows a part of a resin cylinder head cover 2 according to the first embodiment to which an OCV 6 is attached and the vicinity thereof. FIG. 2 shows, together with the OCV 6, the part of the resin cylinder head cover 2 before the OCV 6 is attached and the vicinity thereof.

As shown in FIG. 1, the cylinder head cover 2 includes a resin cylinder head cover main body 3 and a valve case 4. The valve case 4 is formed separately from the cover main body 3 and is attached to the cover main body 3. The valve case 4 is integrally molded with resin into a shape as shown in FIGS. 3(A) to 3(F).

The valve case 4 has a plate-like flange portion 10, which is a joint portion. A resin attaching portion 12 formed into a substantially cylindrical shape with resin is located on the upper surface of the flange portion 10. A sleeve 14 is embedded in the resin that forms the resin attaching portion 12 with an OCV insertion end 14*a* open to the outside. The sleeve 14 is integrated with the resin attaching portion 12 through insert molding when the valve case 4 is integrally formed with resin.

The sleeve 14 is cylindrical as shown in FIGS. 4(A) to 4(E) and is formed of material having the same coefficient of thermal expansion as a spool housing 7 of the OCV 6 shown in FIGS. 1 and 2. More specifically, the sleeve 14 is formed of aluminum base alloy. The sleeve 14 may also be formed of metal material that is exactly the same as the spool housing 7 of the OCV 6.

The sleeve 14 includes oil holes 18, 20, 22, 24, 26, which are formed at positions corresponding to five ports 7*a*, 7*b*, 7*c*, 7*d*, 7*e* formed on the spool housing 7 of the OCV 6. The oil holes 18, 20, 22, 24, 26 communicate with an interior space of the sleeve 14, which is a mounting bore 16. A tapered surface 28 is formed at the OCV insertion end 14*a* of the sleeve 14 to facilitate attachment of the OCV 6. In FIGS. 1 and 2, the oil holes 18, 20, 22 are shown by a broken line on the sleeve 14 since the oil holes 18, 20, 22 are located in a part that has been cut away.

Primer is applied to an outer circumferential surface 14*b* of the sleeve 14 before insert molding. Therefore, the sleeve 14 is strongly bonded with resin of the resin attaching portion 12 of the valve case 4 formed by insert molding due to the primer. During insert molding, slide pins are arranged in the mold to be continuous with the oil holes 18 to 26 formed in the sleeve 14. In this manner, oil passages that are connected to the oil holes 18 to 26 are also formed in the valve case 4.

Three oil passage portions 38, 40, 42 are formed on the outer circumferential portion of the resin attaching portion 12. Among the above mentioned oil passages of the valve case 4, three oil passages 38*a*, 40*a*, 42*a* are formed in the oil passage portions 38, 40, 42, respectively. The oil passages 38*a*, 40*a*, 42*a* are connected to the three oil holes 18, 20, 22 of the sleeve 14, respectively. The middle oil passage portion 40, which is a supplying oil passage portion, has the oil passage 40*a*, which is a supplying oil passage, connected to a hydraulic pressure supplying channel of a cylinder head 44 through a pipe and other oil passages. Thus, hydraulic pressure is supplied to the OCV 6 inside the sleeve 14. The oil passage portions 38, 42, which are draining oil passage portions located on both sides of the middle oil passage portion 40, include the oil passages 38*a*, 42*a*, which are draining oil passages. Hydraulic oil is thus directly drained from the OCV 6 to the interior of the resin cylinder head cover 2.

Furthermore, among the above mentioned oil passages of the valve case 4, intermediate oil passages 46, 48 are connected to the oil holes 24, 26 of the sleeve 14. The intermediate oil passages 46, 48 are formed in a resin oil passage coupling portion 50. The intermediate oil passages 46, 48 permit hydraulic pressure to be supplied and drained between the OCV 6 and a variable valve actuation mechanism, which is a variable valve timing mechanism 30 (see FIGS. 1 and 2). An O-ring 52 is located below the lower surface of the resin oil passage coupling portion 50 about the openings of the intermediate oil passages 46, 48 and acts as a sealing when the resin oil passage coupling portion 50 abuts against the upper surface of a cam cap 54.

A bolt screw-in hole 12*b* is formed in an OCV insertion end 12*a* of the resin attaching portion 12. As shown in FIG. 1, when the spool housing 7 of the OCV 6 is accommodated in the mounting bore 16 of the sleeve 14, a bolt hole 6*c* of a bracket 6*b* provided on the OCV 6 is located in front of the bolt screw-in hole 12*b*. Thus, the OCV 6 is fastened to the valve case 4 by fastening a bolt to the bolt screw-in hole 12*b* through the bolt hole 6*c*.

The valve case 4 configured as described above is formed by first arranging the sleeve 14 in a mold for injection molding and then integrally molding the flange portion 10, the resin attaching portion 12, and the resin oil passage coupling portion 50 with resin.

The valve case 4 formed as described above is attached to the resin cylinder head cover main body 3 by, as shown in FIG. 2, inserting the resin oil passage coupling portion 50 into an opening portion 3*a* of the resin cylinder head cover main body 3, and then joining the flange portion 10 to the upper surface of the resin cylinder head cover main body 3 by welding at the circumference of the opening portion 3*a*. As a result, the opening portion 3*a* of the resin cylinder head cover main body is completely closed.

Figure 3A:
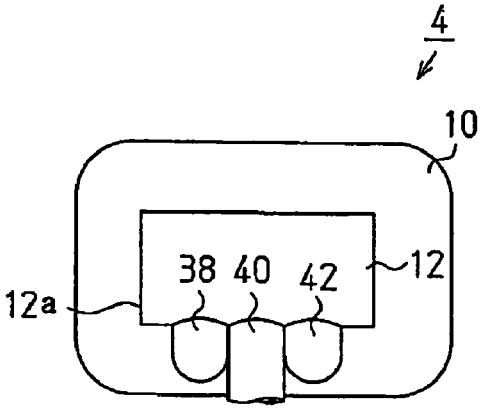
FIG. 3(A) is a plan view illustrating a valve case of the cylinder head cover of FIG. 1.
Figure 3D:
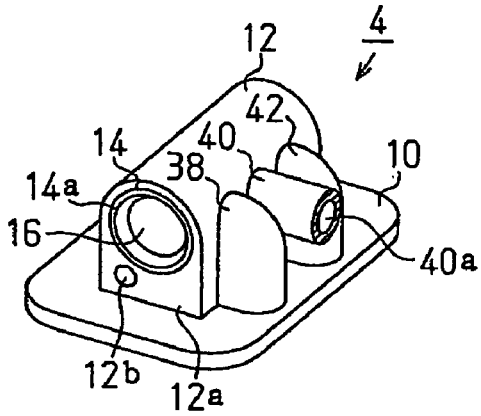
FIG. 3(D) is a perspective view illustrating the valve case of FIG. 3(A)
Figure 3B:
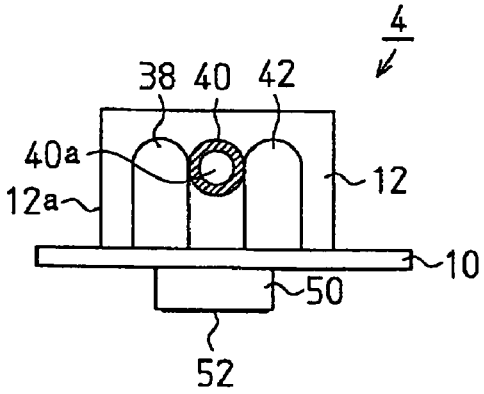
FIG. 3(B) is a front view illustrating the valve case of FIG. 3(A)
Figure 3E:
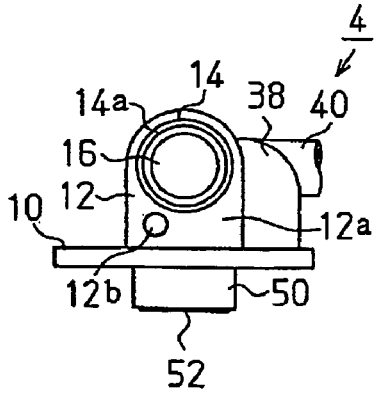
FIG. 3(E) is a left side view illustrating the valve case of FIG. 3(A)
Figure 3C:
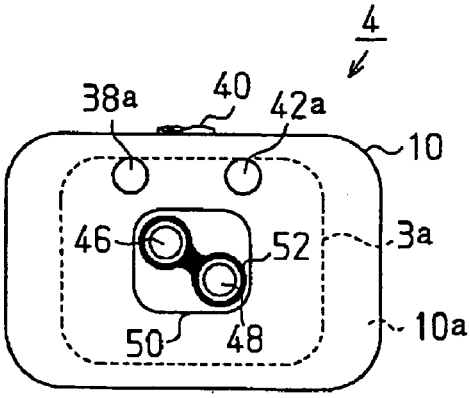
FIG. 3(C) is a bottom view illustrating the valve case of FIG. 3(A)
Figure 3F:
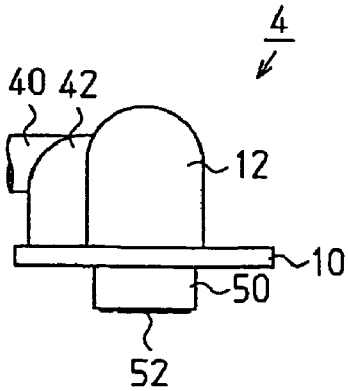
FIG. 3(F) is a right side view illustrating the valve case of FIG. 3(A)
Figure 4A:
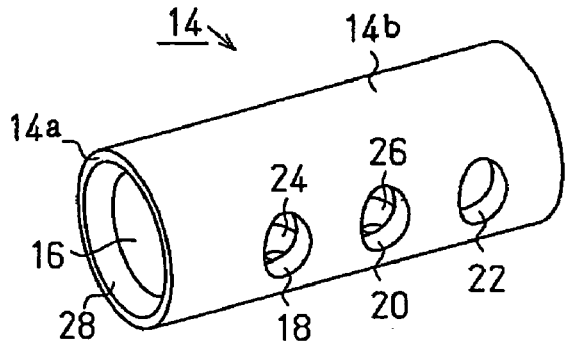
FIG. 4(A) is a perspective view illustrating a sleeve of the cylinder head cover of FIG. 1.
Figure 4B:
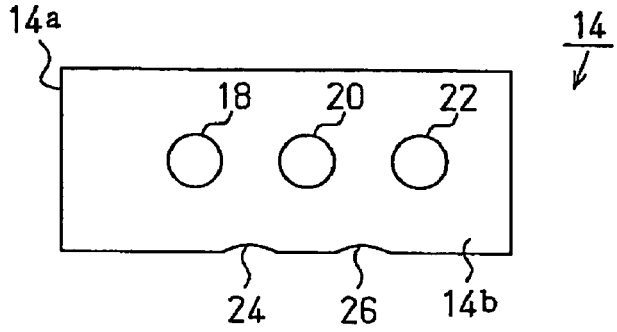
FIG. 4(B) is a front view illustrating the sleeve of FIG. 4(A)
Figure 4C:
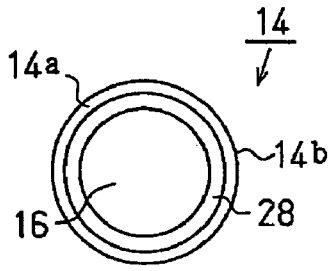
FIG. 4(C) is a left side view illustrating the sleeve of FIG. 4(A)
Figure 4D:
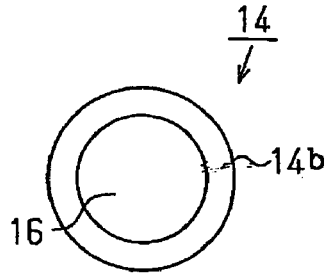
FIG. 4(D) is a right side view illustrating the sleeve of FIG. 4(A)
Figure 4E:
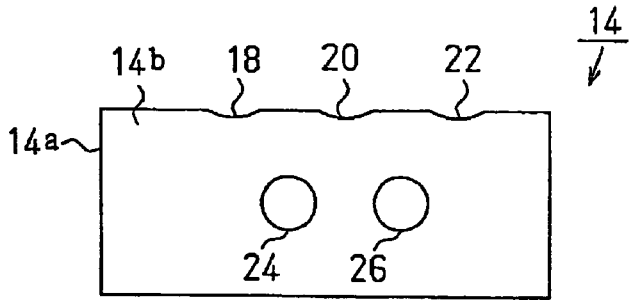
FIG. 4(E) is a rear view illustrating the sleeve of FIG. 4(A)

A broken line in FIG. 3(C) represents the arrangement of the opening portion 3*a* of the resin cylinder head cover main body 3 with respect to the flange portion 10 of the valve case 4 when the flange portion 10 is welded to the resin cylinder head cover main body 3. The flange portion 10 is welded at the entire circumference of the opening portion 3*a* in an area 10*a* of the flange portion 10 where the resin cylinder head cover main body 3 and the flange portion 10 overlap each other. Therefore, the draining oil passages 38*a*, 42*a* can drain hydraulic oil to the inside of the resin cylinder head cover 2. The supplying oil passage 40*a* in the middle supplying oil passage portion 40 is connected to a supplying passage in the cylinder head cover main body 3, thereby permitting hydraulic oil to be supplied to the OCV 6.

The opening portion 3*a* of the resin cylinder head cover main body 3 is directly above the cam cap 54, which is one of cam caps that is closest to the variable valve timing mechanism 30, when the resin cylinder head cover 2 is attached to the cylinder head 44. Thus, when the resin cylinder head cover 2 is fastened to the cylinder head 44 with a bolt as shown in FIG. 2, the intermediate oil passages 46, 48 of the resin oil passage coupling portion 50 are connected to cam cap oil passages 54*a*, 54*b* of the cam cap 54, respectively.

The spool housing 7 of the OCV 6 is inserted in the resin cylinder head cover 2 configured as described above from the OCV insertion end 14*a* of the sleeve 14 as shown in FIG. 2 so that the spool housing 7 is accommodated in the mounting bore 16 of the sleeve 14. The mounting bore 16 of the sleeve 14 is formed with high precision such that the clearance between the spool housing 7 and the sleeve 14 is constant. Since the sleeve 14 is formed of metal material that has rigidity sufficiently higher than resin that forms the resin attaching portion 12, the dimensional accuracy of the mounting bore 16 is sufficiently maintained even if the resin is distorted after insert molding, the resin is deformed when the resin cylinder head cover 2 is fastened to the cylinder head 44, or thermal deformation is caused subsequently. Therefore, the spool housing 7 is easily inserted to a predetermined position in the mounting bore 16, and the OCV 6 is attached to the resin attaching portion 12 in a suitable manner as shown in FIG. 1. An O-ring 7*f* is arranged at the proximal portion of the spool housing 7 to prevent hydraulic oil that slightly leaks from the clearance between the spool housing 7 and the sleeve 14 from being drained to the outside of the resin cylinder head cover 2. The bracket 6*b* is then fastened with a bolt and the attachment of the OCV 6 is completed.

The OCV 6 is mounted as described above and an electronic control unit (ECU) 58 controls exciting current to a solenoid section 6*a* of the OCV 6 in accordance with the operating state of the engine. Accordingly, the hydraulic pressure supplied to the port 7*b* of the spool housing 7 from the supplying oil passage 40*a* is supplied to one of the oil holes 24, 26 and drained from the other one of the oil holes 24, 26. In this manner, the hydraulic pressure is supplied to and drained from the variable valve timing mechanism 30 using the intermediate oil passages 46, 48, the cam cap oil passages 54*a*, 54*b*, and two oil passages 60*a*, 60*b* located in a camshaft 60. For example, the variable valve timing mechanism 30 is retarded when the hydraulic pressure is supplied to the variable valve timing mechanism 30 through one of the channels, that is, through the intermediate oil passage 48, the cam cap oil passage 54*b*, and the oil passage 60*b*, and the hydraulic pressure is drained via the other channel, that is, the intermediate oil passage 46, the cam cap oil passage 54*a*, and the oil passage 60*a*. Thus, the rotational phase of the camshaft 60 with respect to a timing sprocket 62 is retarded, thereby retarding the valve timing.

Contrastingly, the variable valve timing mechanism 30 is advanced when the hydraulic pressure is supplied to the variable valve timing mechanism 30 through the intermediate oil passage 46, the cam cap oil passage 54*a*, and the oil passage 60*a*, and is drained through the intermediate oil passage 48, the cam cap oil passage 54*b*, and the oil passage 60*b*. Thus, the rotational phase of the camshaft 60 with respect to the timing sprocket 62 is advanced, thereby advancing the valve timing.

The first embodiment has the following advantages.

(a) The valve case 4 is joined to the cylinder head cover main body 3 at the flange portion 10 to form the resin cylinder head cover 2 as a whole. The flange portion 10 is located at the outer circumference of the middle portion between the resin attaching portion 12 and the resin oil passage coupling portion 50 of the valve case 4. Therefore, if the cylinder head cover main body 3 is distorted or deformed when being attached to the cylinder head 44 after the valve case 4 is integrated with the cylinder head cover main body 3, distortion or deformation is transmitted to the middle portion between the resin attaching portion 12 and the resin oil passage coupling portion 50 from the flange portion 10.

Thus, distortion or deformation of the cylinder head cover main body 3 does not significantly affect the shape of the resin attaching portion 12.

Furthermore, the sleeve 14 formed of material that has higher rigidity than the resin forming the resin attaching portion 12 is embedded in the resin attaching portion 12. The interior space of the sleeve 14 forms the mounting bore 16 in which the OCV 6 is accommodated.

Therefore, even if distortion or deformation of the cylinder head cover main body 3 is slightly transmitted to the resin attaching portion 12, the sleeve 14 having high rigidity prevents distortion or deformation from affecting the shape of the mounting bore 16 in the sleeve 14.

As described above, applying the valve case 4 of the first embodiment to the resin cylinder head cover 2 prevents deformation of the attaching portion 12 that can cause poor attachment or malfunction of the OCV 6.

(b) The flange portion 10 is formed at the entire circumference of the middle portion of the valve case 4 between the resin attaching portion 12 and the resin oil passage coupling portion 50. Therefore, the valve case 4 is joined to the cylinder head cover main body 3 in a hermetically closed state with the opening portion 3*a* of the cylinder head cover main body 3 completely closed. Furthermore, distortion or deformation of the cylinder head cover main body 3 is almost completely absorbed by the plate-like flange portion 10. Therefore, the amount of distortion or deformation transmitted to the resin attaching portion 12 is decreased, and further reduces the influence on the shape of the mounting bore 16 of the sleeve 14. This contributes to the weight reduction of the sleeve 14 such as reducing the thickness of the sleeve 14.

Furthermore, since the flange portion 10 and the cylinder head cover main body 3 are both formed of resin, the flange portion 10 is easily joined to the cylinder head cover main body 3 by welding.

(c) The valve case 4 is formed by integrally molding the resin attaching portion 12 except the sleeve 14, the resin oil passage coupling portion 50, and the flange portion 10 with one type of resin. The sleeve 14 is embedded in and secured to the resin attaching portion 12 through insert molding simultaneously as when the valve case 4 is integrally molded. Therefore, the valve case 4 integrated with the sleeve 14 is easily formed.

(d) Since the sleeve 14 is metal, the mounting bore 16, in particular, is machined with high precision. Therefore, the OCV 6 is properly attached to the mounting bore 16.

(e) Since the cylinder head cover 2 is formed by separately manufacturing the resin cylinder head cover main body 3 and the valve case 4, the shape of each of the resin cylinder head cover main body 3 and the valve case 4 is simplified. This facilitates manufacture of molds used for injection molding.

The valve case 4 in which the sleeve 14 is embedded in the resin attaching portion 12 in advance, in particular, the valve case 4 in which the sleeve 14 is embedded by insert molding is joined to the resin cylinder head cover main body 3. Therefore, a process for embedding the sleeve 14 is not complicated.

This is because, if the sleeve 14 is to be embedded in the resin attaching portion 12 after the valve case 4 is joined to the resin cylinder head cover main body 3, the portion where the sleeve 14 is to be embedded may get deformed during joining process.

(f) The valve case 4 is located directly above the cam cap 54, which is one of the cam caps that is closest to the variable valve timing mechanism 30. Therefore, the OCV 6 controls supply and drainage of the hydraulic pressure to and from the variable valve timing mechanism 30 using very short oil passages. This further increases the speed of the pressure response and improves the control response of the variable valve timing mechanism 30.

Figure 5:
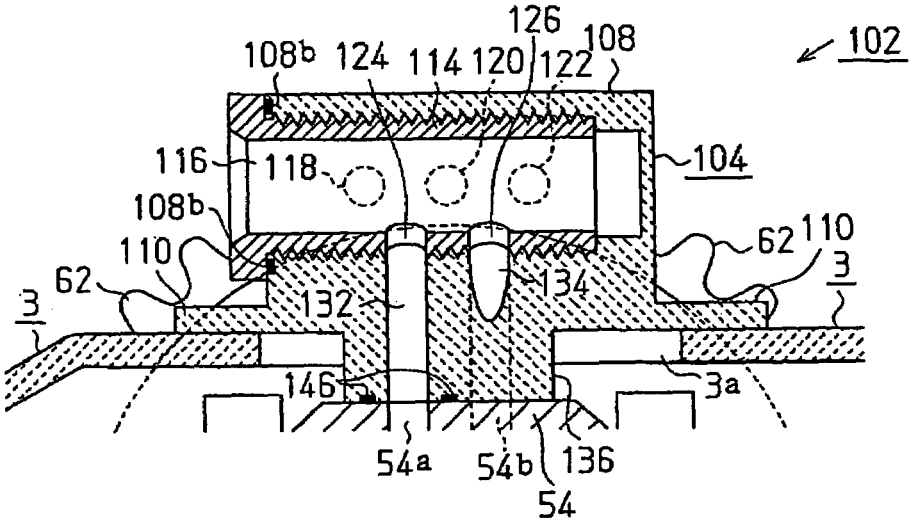
FIG. 5 is a longitudinal cross-sectional view illustrating a valve case and the vicinity thereof according to a second embodiment of the present invention.

A second embodiment of the present invention will now be described with reference to FIGS. 5 and 6. FIG. 5 shows a valve case 104 according to the second embodiment attached to a resin cylinder head cover main body 103. The second embodiment has the same configuration as the first embodiment except the attachment structure of a sleeve 114 and a resin attaching portion 108.

Figure 6:
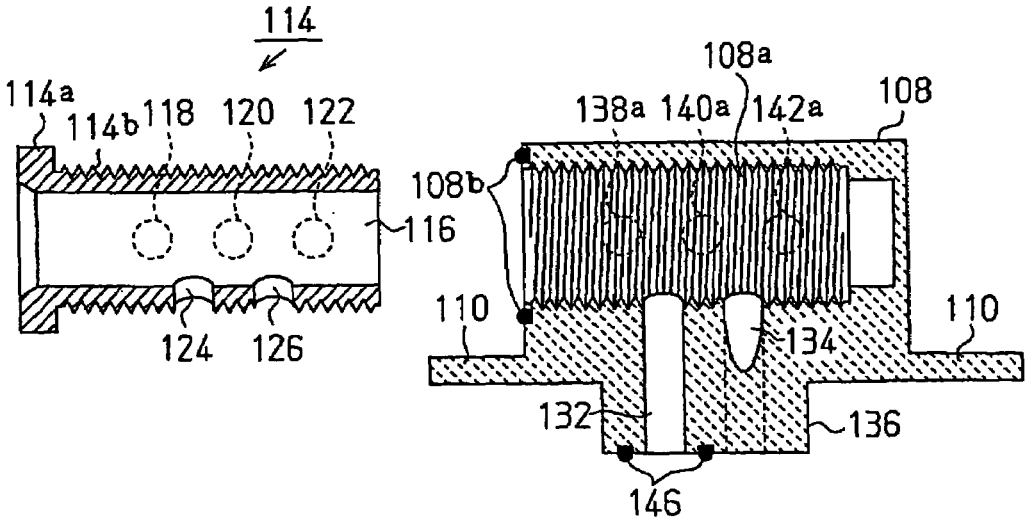
FIG. 6 is a longitudinal cross-sectional view illustrating, together with the sleeve, the valve case of FIG. 5 before the sleeve is attached to an attaching portion and the vicinity thereof.

In the second embodiment, an internal thread portion 108*a* is formed on the inner circumferential surface of the resin attaching portion 108 as shown in FIG. 6 during integral molding of the resin portion of the valve case 104 using a mold. Alternatively, the internal thread portion 108*a* is not formed during integral molding but is formed after the integral molding on the inner circumferential surface of the resin attaching portion 108 by thread cutting.

An external thread portion 114*b* is formed on the outer circumferential surface of the sleeve 114. The sleeve 114 is screwed to the internal thread portion 108*a* and is embedded in the resin attaching portion 108. When the sleeve 114 is screwed to the resin attaching portion 108, a draining oil passage 138*a*, a supplying oil passage 140*a*, a draining oil passage 142*a*, intermediate oil passages 132, 134 are aligned with oil holes 118, 120, 122, 124, 126 of the sleeve 114, respectively. In FIGS. 5 and 6, the oil passages 138*a*, 140*a*, 142*a*, and the oil holes 118, 120, 122 are shown by a broken line since the oil passages 138*a*, 140*a*, 142*a*, and the oil holes 118, 120, 122 are located in a part that has been cut away.

When the sleeve 114 is screwed to the resin attaching portion 108, an O-ring 108*b* located at the rim of the opening end of the resin attaching portion 108 abuts against a flange 114*a* of the sleeve 114. Consequently, the joint portion between the external thread portion 114*b* and the internal thread portion 108*a* is sealed. To facilitate understanding, only the cut surfaces of the O-ring 108*b* and an O-ring 146 of the resin oil passage coupling portion 136 are shown in FIG. 6.

The sleeve 114 may be secured to the resin attaching portion 108 only by screwing, but the sleeve 114 may be screwed to the attaching portion 108 after applying sealing material or an adhesive to the external thread portion 114*b* or the internal thread portion 108*a*. In this case, the O-ring 108*b* does not need to be used.

After the valve case 104 is completed as described above, the valve case 104 is joined to the resin cylinder head cover main body 103 at the flange portion 110 in the same manner as in the first embodiment to complete the resin cylinder head cover 102. The resin cylinder head cover 102 is then attached to the cylinder head. Thereafter, an OCV is accommodated in a mounting bore 116 in the sleeve 114, and a bracket of the OCV is fastened to the valve case 104.

The second embodiment has the following advantage.

(a) Since the valve case 104 and the sleeve 114 are integrated by screwing them together, the sleeve 114 and the valve case 104 are secured in a stable manner although the sleeve 114 is formed of material different from the valve case 104.

With this configuration also, the advantages (a) to (f) of the first embodiment are provided.

The embodiments may be modified as follows

The sleeve 14 is embedded in the resin attaching portion 12 by insert molding in the first embodiment, and the sleeve 114 is embedded in the resin attaching portion 108 by screwing, or mechanical fastening, in the second embodiment. However, the sleeve 14, 114 may be embedded in the resin attaching portion 12, 108 in a state where the sleeve 14, 114 is adhered to the resin attaching portion 12, 108 with an adhesive.

Further, in a case where insert molding is performed, an adhesive such as an epoxy resin based adhesive may be applied to the outer circumferential surface 14*b* of the sleeve 14, 114 instead of the primer, or an adhesive may be applied on the primer before insert molding so that the adhesive strongly bonds with the resin of the resin attaching portion 12, 108.

In each of the above embodiments, the flange portion 10, 110 of the valve case 4, 104 is joined to the resin cylinder head cover main body 3, 103 by welding, but the flange portion 10, 110 may be joined to the main body 3, 103 using an adhesive. Alternatively, the flange portion 10, 110 of the valve case 4, 104 may be joined to the resin cylinder head cover main body 3, 103 by welding and using an adhesive. Sealing material may be applied between the flange portion 10, 110 and the resin cylinder head cover main body 3, 103 to join the flange portion 10, 110 with the entire circumference or part of the circumference of the opening portion 3*a* of the cylinder head cover main body 3, 103.

In each of the above embodiments, the flange portion 10, 110 is located at the intermediate portion of the valve case 4, 104 between the resin attaching portion 12, 108 and the resin oil passage coupling portion, but may be located at the outer circumference of the resin oil passage coupling portion 50, 136. This further reduces the influence of distortion or deformation of the cylinder head cover main body on the resin attaching portion.

The variable valve timing mechanism 30 may be other variable valve actuation mechanisms such as a variable valve lift mechanism.

The invention claimed is:

1. A valve case that permits an oil control valve to be attached, the oil control valve having ports and controlling supply and drainage of hydraulic pressure to and from a variable valve actuation mechanism of an internal combustion engine, and the valve case is attached to a cylinder head cover main body formed of resin, the valve case comprising:

an attaching portion formed of resin, the attaching portion is a portion of the valve case to which the oil control valve is to be attached;

a sleeve embedded in the attaching portion, the sleeve having an interior space that permits the oil control valve to be accommodated therein and oil holes, wherein each oil hole is selectively connected to one of the ports of the oil control valve accommodated in the interior space of the sleeve, and the sleeve being formed of material having higher rigidity than the resin forming the attaching portion;

an oil passage coupling portion formed of resin, the oil passage coupling portion having intermediate oil passages, the intermediate oil passages each connect one of the oil holes of the sleeve to a corresponding one of cam cap oil passages formed in a cam cap of the internal combustion engine to selectively supply and drain hydraulic pressure to and from the variable valve actuation mechanism; and a joint portion formed of resin, the joint portion being located at the outer circumference of a portion of the valve case between the attaching portion and the oil passage coupling portion or at the outer circumference of the oil passage coupling portion, and the joint portion is joined to the cover main body so that the valve case is attached to the cover main body.

2. The valve case according to claim 1, wherein the joint portion is a flange located along the entire outer circumference of a portion of the valve case between the attaching portion and the oil passage coupling portion.

3. The valve case according to claim 1, wherein the attaching portion, the oil passage coupling portion, and the joint portion are integrally molded with one type of resin.

4. The valve case according to claim 1, wherein the sleeve is embedded in the attaching portion through insert molding of the sleeve to the attaching portion.

5. The valve case according to claim 1, wherein the sleeve is embedded in the attaching portion in a state where the sleeve is adhered to the attaching portion with adhesive.

6. The valve case according to claim 1, wherein the sleeve is embedded in the attaching portion in a state where the sleeve is mechanically fastened to the attaching portion.

7. The valve case according to claim 1, wherein the joint portion is joined to the cover main body by welding or adhesion.

8. The valve case according to claim 1, wherein the sleeve is made of metal.

9. A resin cylinder head cover, comprising:

a cylinder head cover main body formed of resin, the cover main body having an opening portion; and the valve case according to claim 1, the valve case being attached to the cover main body to close the opening portion of the cover main body by inserting the oil passage coupling portion into the opening portion and joining the joint portion to the cover main body around the opening portion.

10. The cylinder head cover according to claim 9, wherein the valve case is joined and attached to the cylinder head cover main body with the sleeve embedded in the attaching portion in advance.

11. The cylinder head cover according to claim 9, wherein the cam cap is one of a plurality of cam caps that is located closest to the variable valve actuation mechanism, and the valve case is located substantially directly above the one of the cam caps.

* * * * *